US010864622B2

(12) United States Patent
Yoshikane

(10) Patent No.: US 10,864,622 B2
(45) Date of Patent: Dec. 15, 2020

(54) STRIKING TOOL

(71) Applicant: MAKITA CORPORATION, Anjo (JP)

(72) Inventor: Kiyonobu Yoshikane, Anjo (JP)

(73) Assignee: MAKITA CORPORATION, Anjo (JP)

( * ) Notice: Subject to any disclaimer, the term of this patent is extended or adjusted under 35 U.S.C. 154(b) by 214 days.

(21) Appl. No.: 16/039,499

(22) Filed: Jul. 19, 2018

(65) Prior Publication Data

US 2019/0118365 A1 Apr. 25, 2019

(30) Foreign Application Priority Data

Oct. 20, 2017 (JP) ..... 2017-203827

(51) Int. Cl.
*B25D 17/24* (2006.01)
*B25D 16/00* (2006.01)
*B25D 11/12* (2006.01)

(52) U.S. Cl.
CPC ..... *B25D 17/24* (2013.01); *B25D 11/125* (2013.01); *B25D 16/00* (2013.01); *B25D 16/006* (2013.01); *B25D 16/003* (2013.01); *B25D 2211/068* (2013.01); *B25D 2216/0084* (2013.01); *B25D 2217/0076* (2013.01); *B25D 2217/0088* (2013.01); *B25D 2250/121* (2013.01); *B25D 2250/265* (2013.01); *B25D 2250/391* (2013.01)

(58) Field of Classification Search
CPC ..... B25D 17/24; B25D 11/125; B25D 16/00; B25D 16/006; B25D 16/003; B25D 2211/068; B25D 2216/0084; B25D 2217/0076; B25D 2217/0088; B25D 2250/121; B25D 2250/265; B25D 2250/391
USPC ... 173/162.2, 162.1, 201, 210, 104, 109, 48, 173/110
See application file for complete search history.

(56) References Cited

U.S. PATENT DOCUMENTS 3,161,242 A * 12/1964 Etzkorn ..... B25D 17/06 173/109
3,275,088 A * 9/1966 Schrottle ..... B25D 11/12 173/110
3,299,967 A * 1/1967 Cabot ..... B25C 1/06 173/201
3,305,031 A * 2/1967 Bez ..... B25D 11/12 173/115
5,134,777 A * 8/1992 Meyer ..... B23D 49/167 30/392
6,907,943 B2 * 6/2005 Ikuta ..... B25D 11/125 173/117

(Continued)

FOREIGN PATENT DOCUMENTS

JP 5015697 B2 8/2012

*Primary Examiner* — Dariush Seif
(74) *Attorney, Agent, or Firm* — Oliff PLC

(57) ABSTRACT

Vibrations resulting from a reciprocating piston and vibrations resulting from a rotating crank shaft are reduced effectively. A housing for a hammer drill accommodates, at a position at which a cap closes a supply port, a counterweight movable in cooperation with a crank mechanism to reduce vibrations in a striking axis direction resulting from a reciprocating piston, and a second counterweight rotatable in cooperation with the crank mechanism to reduce vibrations in a rotational direction resulting from a crank shaft.

20 Claims, 14 Drawing Sheets

(56) References Cited

U.S. PATENT DOCUMENTS 7,059,425 B2 * 6/2006 Ikuta ..... B25D 11/005 173/117
7,513,317 B2 * 4/2009 Satou ..... B25D 17/24 173/109
7,996,996 B2 * 8/2011 Hirabayashi ..... B23D 51/16 30/392
8,267,191 B2 * 9/2012 Furusawa ..... B25D 17/24 173/104
8,997,887 B2 * 4/2015 Furusawa ..... B23Q 17/2404 173/198
9,505,118 B2 * 11/2016 Furusawa ..... B25D 17/043
10,259,060 B2 * 4/2019 Sugino ..... B23D 49/162
10,518,400 B2 * 12/2019 Furusawa ..... B25D 11/062
2004/0194986 A1 * 10/2004 Ikuta ..... B25D 17/24 173/48
2004/0206520 A1 * 10/2004 Ikuta ..... B25D 11/125 173/48
2004/0222001 A1 * 11/2004 Ikuta ..... B25D 11/125 173/210
2004/0255475 A1 * 12/2004 Hirabayashi ..... B23D 51/16 30/392
2006/0048958 A1 * 3/2006 Ikuta ..... B25D 17/24 173/201
2007/0017684 A1 * 1/2007 Stirm ..... B25D 11/062 173/109
2008/0277128 A1 * 11/2008 Satou ..... B25F 5/006 173/48
2009/0032275 A1 * 2/2009 Ikuta ..... B25D 17/24 173/117
2009/0223693 A1 * 9/2009 Aoki ..... B25D 17/24 173/211
2010/0175903 A1 * 7/2010 Ikuta ..... B25D 17/24 173/2
2011/0226500 A1 * 9/2011 Furusawa ..... B25D 17/26 173/110
2011/0239474 A1 * 10/2011 Hirabayashi ..... B23D 51/16 30/392
2012/0192438 A1 * 8/2012 Aoki ..... B23D 51/16 30/392
2013/0048327 A1 * 2/2013 Machida ..... B25D 11/062 173/162.2
2014/0083728 A1 * 3/2014 Gensmann ..... B25D 9/16 173/1
2015/0266176 A1 * 9/2015 Takeuchi ..... B25D 17/20 173/117

* cited by examiner

STRIKING TOOL

CROSS-REFERENCE TO RELATED APPLICATIONS

This application claims the benefit of priority to Japanese Patent Application No. 2017-203827, filed on Oct. 20, 2017, the entire contents of which are hereby incorporated by reference.

BACKGROUND

1. Technical Field

The present invention relates to a striking tool, such as a hammer drill, including a crank mechanism.

2. Description of the Background

A known striking tool, such as a hammer drill, includes a striking mechanism and a crank mechanism accommodated in a housing. The striking mechanism includes a striker for striking a bit and a piston for moving the striker in a cooperative manner. The crank mechanism includes a crank shaft, which is driven and rotated by a motor, and an eccentric pin on the crank shaft, which is connected to the piston with a connecting rod to convert the rotation of the crank shaft to reciprocation of the piston. Japanese Patent No. 5015697 describes a striking tool including a low-vibration mechanism for reducing vibrations by canceling a shifted center of gravity resulting from a piston reciprocating in cooperation with a crank mechanism. The striking tool has, above the crank mechanism, a grease supply port, which is closed by a cap containing the low-vibration mechanism such as a counterweight. The low-vibration mechanism is removable from the housing when the cap is removed.

BRIEF SUMMARY

The known striking tool includes the low-vibration mechanism to reduce vibrations resulting from the reciprocating piston. However, the counterweight included in the low-vibration mechanism and the rotating component such as the crank shaft rotate, thus increasing rotational imbalance and causing more vibrations.

One or more aspects of the present invention are directed to a striking tool that reduces vibrations resulting from a reciprocating piston and vibrations resulting from a rotating component such as a rotating crank shaft.

A striking tool, comprising:

a housing including a supply port;

a striking mechanism placeable in the housing, the striking mechanism including a striker movable back and forth in a striking axis direction, and a piston configured to move the striker back and forth;

a crank mechanism placeable in the housing, the crank mechanism including a crank shaft rotatable when driven by a motor, and an eccentric pin on the crank shaft, the eccentric pin being movable eccentrically;

a cap that is attached to the supply port in a removable manner;

a first counterweight placeable in the housing at a position at which the cap closes the supply port, the first counterweight being movable in cooperation with the crank mechanism, and being configured to reduce vibrations in the striking axis direction resulting from the piston that is reciprocating; and a second counterweight placeable in the housing at a position at which the cap closes the supply port, the second counterweight being rotatable in cooperation with the crank mechanism, and being configured to reduce vibrations in a rotational direction resulting from the crank shaft.

The striking tool according to the above aspect of the present invention includes the first counterweight for reducing vibrations in the striking axis direction, and the second counterweight for reducing vibrations in the rotational direction resulting from the crank shaft, and thus effectively reduces vibrations resulting from the reciprocating piston as well as vibrations resulting from the rotating component, such as the rotating crank shaft.

DETAILED DESCRIPTION

Embodiments of the present invention will now be described below with reference to the drawings.

Figure 1:
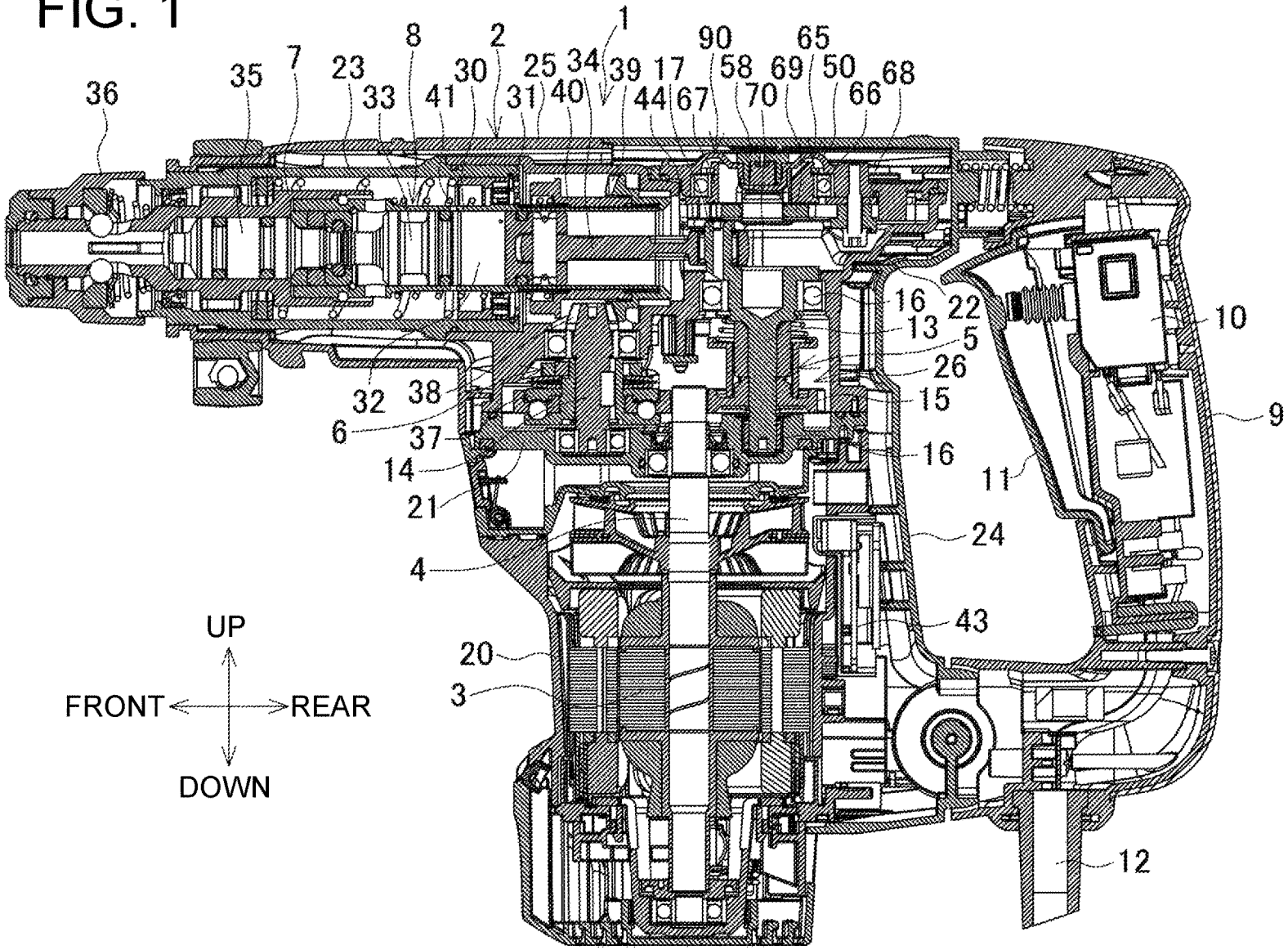
FIG. 1 is a longitudinal central sectional view of a hammer drill.

FIG. 1 is a longitudinal sectional view of a hammer drill as an example of a striking tool. The hammer drill 1 includes a housing 2, a motor 3, a crank mechanism 5, a rotation transmission mechanism 6, and a tool holder 7. The motor 3 has an output shaft 4 facing upward, and is arranged rearward in the housing 2. The crank mechanism 5 and the rotation transmission mechanism 6 are arranged above the motor 3. The tool holder 7 can hold a bit (not shown) in its front end. The tool holder 7 has the axis extending in a front-rear direction, and is rotatable.

The tool holder 7 accommodates a striking mechanism 8, which strikes the bit in the direction of the striking axis that is coaxial with the tool holder 7. As the output shaft 4 rotates, the rotation is transmitted through the crank mechanism 5 and the rotation transmission mechanism 6 to strike the bit or to both strike and rotate the bit. The housing 2 includes a handle 9 arranged rearward. The handle 9 has a switch 10 and a switch lever 11. The housing 2 is connected with a power cord 12.

The housing 2 includes a motor housing 20, a gear housing 21, a crank housing 22, a front housing 23, and a rear housing 24. The motor housing 20 accommodates the motor 3. The gear housing 21 connects to the upper end of the motor housing 20 to axially support the output shaft 4, the lower end of a crank shaft 13 included in the crank mechanism 5, and the lower end of an intermediate shaft 14 included in the rotation transmission mechanism 6. The crank housing 22 connects to the upper end of the gear housing 21 to accommodate the crank mechanism 5, the rotation transmission mechanism 6, the tool holder 7, and a rear portion of the striking mechanism 8. The front housing 23 connects to a front portion of the crank housing 22 to hold the tool holder 7 in a rotatable manner. The rear housing 24 covers the rear portions and the right and left sides of the motor housing 20 and the crank housing 22, as well as the upper surface. The rear housing 24 has the handle 9 connected to its rear end. The rear housing 24 includes a housing cover 25 arranged frontward for covering the front housing 23.

The output shaft 4 of the motor 3 extends through the gear housing 21, and protrudes into the crank housing 22 and meshes with a gear 15 on the crank shaft 13. The crank shaft 13 is axially supported in the vertical direction by upper and lower bearings 16 in a crank chamber 26 in the crank housing 22. The crank shaft 13 has a protruding eccentric pin 17 on its upper end.

The striking mechanism 8 includes a cylinder 30, a piston 31, and a striker 33. The cylinder 30 is held by the tool holder 7 and the crank housing 22. The piston 31, which is movable back and forth, is accommodated in the cylinder 30. The striker 33, which is movable back and forth in front of the piston 31 through a pneumatic chamber 32, is accommodated in the cylinder 30. The piston 31 connects to the eccentric pin 17 with a connecting rod 34 to convert the rotation of the crank shaft 13 to reciprocation of the piston 31.

The tool holder 7 accommodates an intermediate member 35 in front of the striker 33. In front of the intermediate member 35, a chuck 36, which receives the bit, is arranged on the front end of the tool holder 7.

The intermediate shaft 14 is axially supported in the vertical direction in front of the output shaft 4. The intermediate shaft 14 has an intermediate gear 37 including a torque limiter on its lower end. The intermediate gear 37 meshes with the output shaft 4. The intermediate shaft 14 has a first bevel gear 38 on its upper end. The first bevel gear 38 meshes with a second bevel gear 39, which is externally mounted on the rear end of the tool holder 7 in a rotatable manner.

The tool holder 7 has a cylindrical clutch 40 and a coil spring 41 externally mounted in front of the second bevel gear 39. The cylindrical clutch 40 connects to the tool holder 7 with a spline, and is movable back and forth. The coil spring 41 urges the clutch 40 toward a retracted position at which the clutch 40 engages with the second bevel gear 39. The clutch 40 at the retracted position transmits the rotation of the second bevel gear 39 to the tool holder 7. The clutch 40 at an advanced position does not transmit the rotation of the second bevel gear 39 to the tool holder 7. In this state, any rotation angle can be selected. The clutch 40 can be located at either an advanced or retracted position by rotating a change lever 42 (FIG. 3) arranged on a side surface of the housing 2.

When the switch lever 11 is pressed to turn on the switch 10, the motor 3 drives the output shaft 4 to turn and thus rotate the crank shaft 13 with the gear 15. The eccentric pin 17 moves eccentrically to cause the piston 31 to reciprocate with the connecting rod 34. The air cushion moves the striker 33 back and forth in a cooperative manner, and the striker 33 strikes the intermediate member 35 and thus strikes the bit on the front end of the tool holder 7.

At the same time, the intermediate shaft 14 rotates with the intermediate gear 37, thus rotating the second bevel gear 39. The clutch 40 at the retracted position transmits the rotation of the second bevel gear 39 to the tool holder 7, allowing the bit to strike while rotating (hammer drill mode). The clutch 40 at the advanced position does not transmit the rotation of the second bevel gear 39 to the tool holder 7, and only transmits the striking motion to the bit (hammer mode). Behind the motor 3, a controller 43 is located in the rear housing 24 to control the amount of power supply for the motor 3. The controller 43 includes an adjustment dial (not shown) uncovered on the side surface of the rear housing 24. The adjustment dial is operated to adjust the rotation speed and the striking number.

Figure 2:
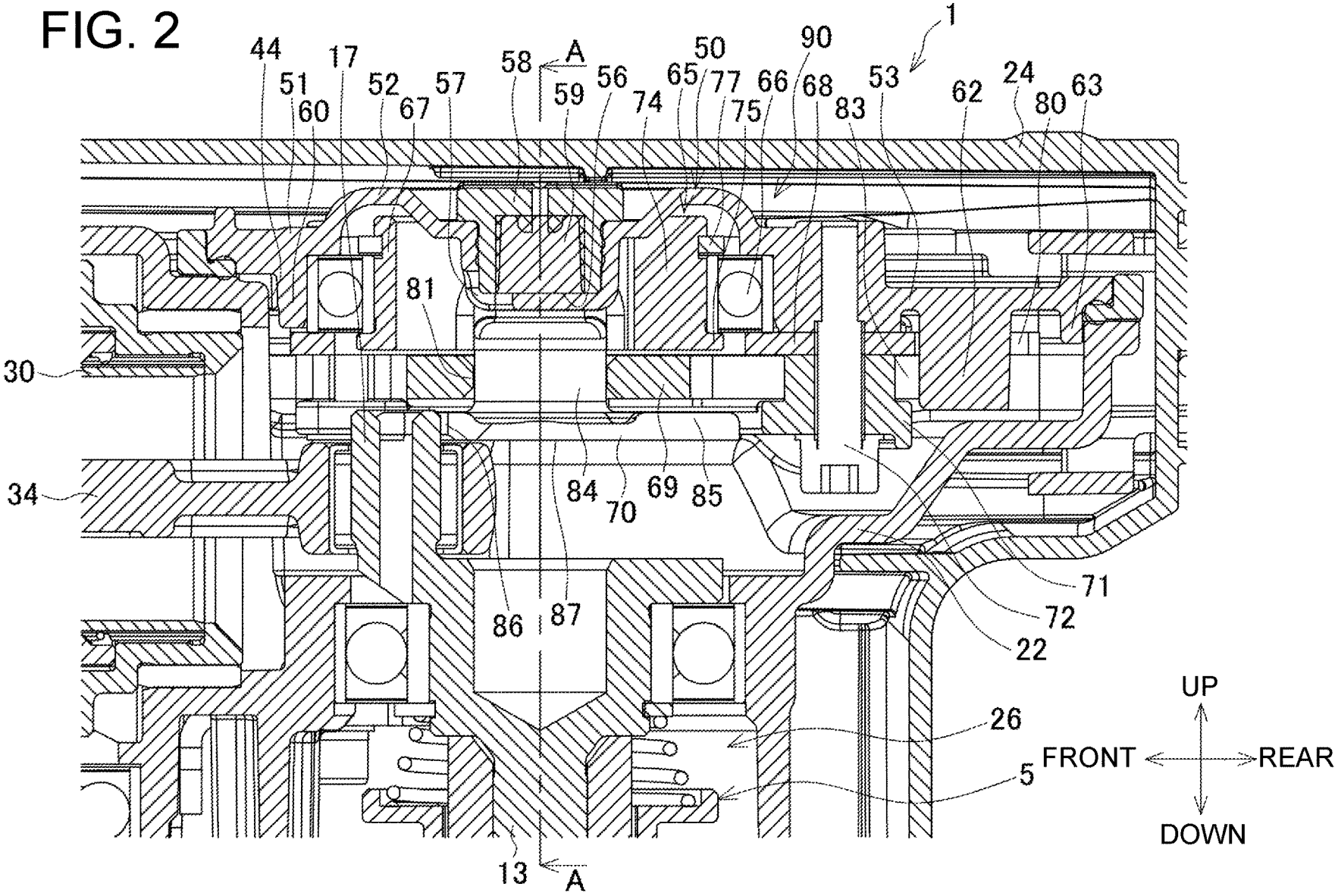
FIG. 2 is an enlarged sectional view of a part including a cap unit.
Figure 3:
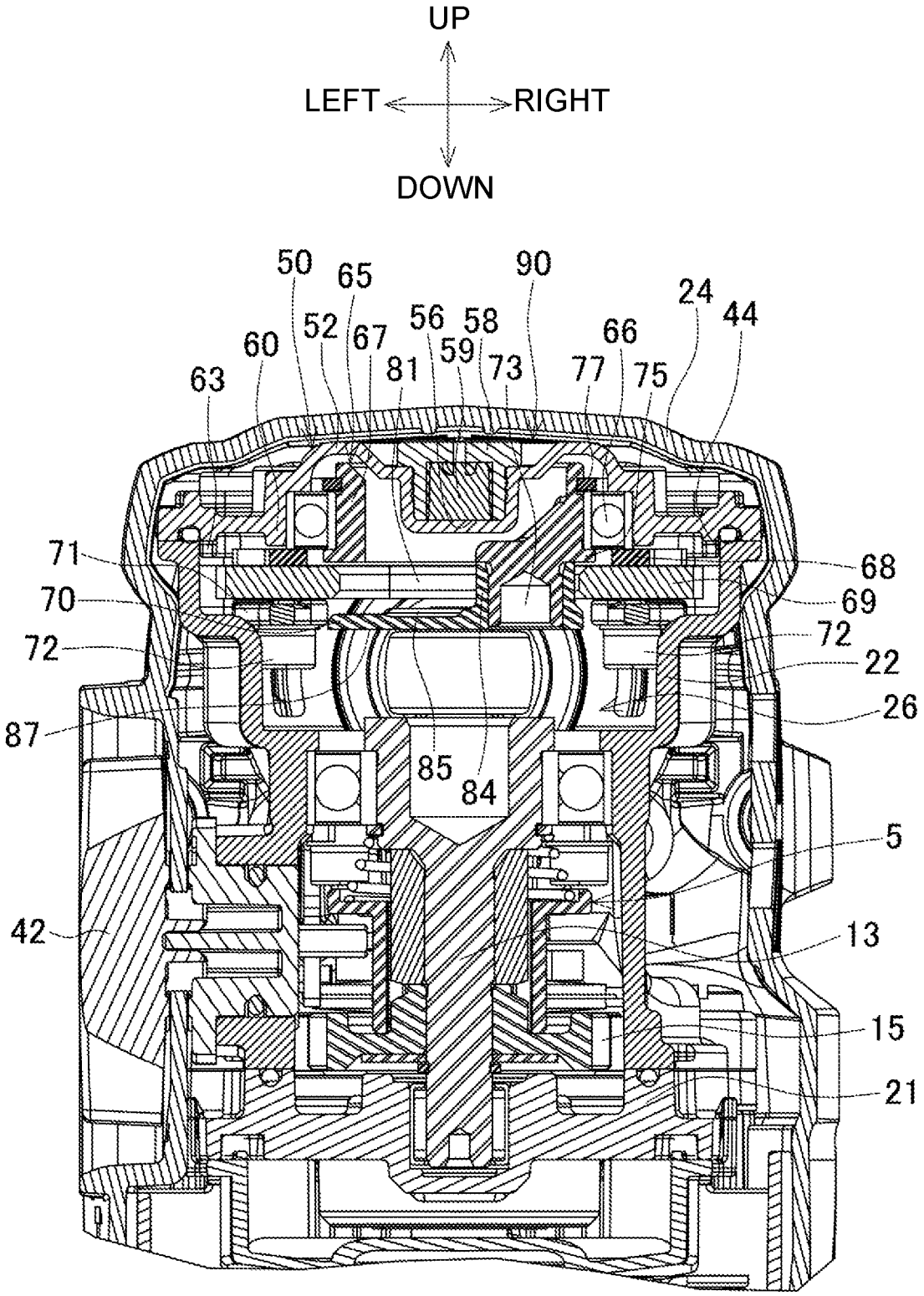
FIG. 3 is a cross-sectional view taken along line A-A in FIG. 2.
Figure 4:
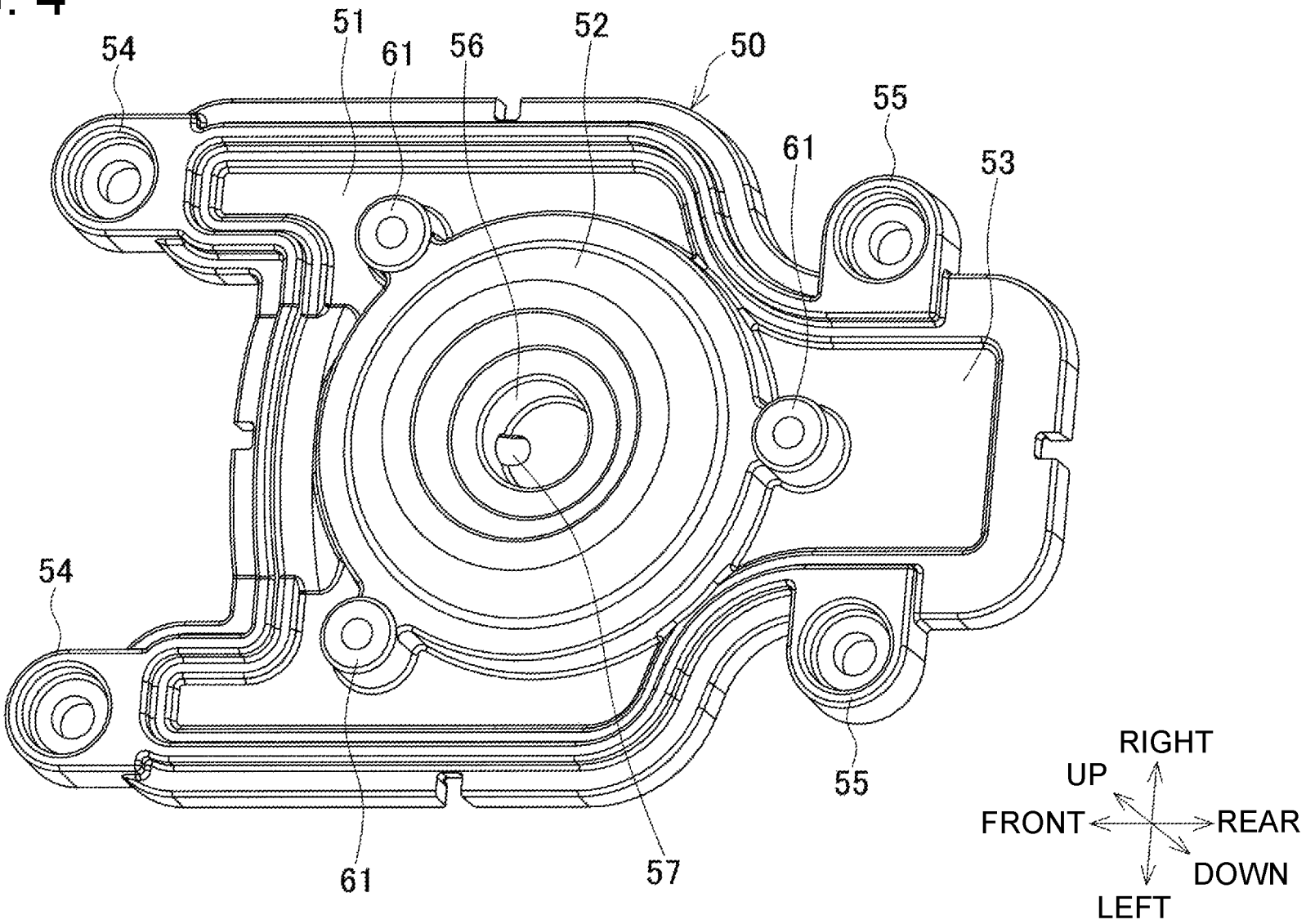
FIG. 4 is a perspective view of a cap from above.
Figure 5A:
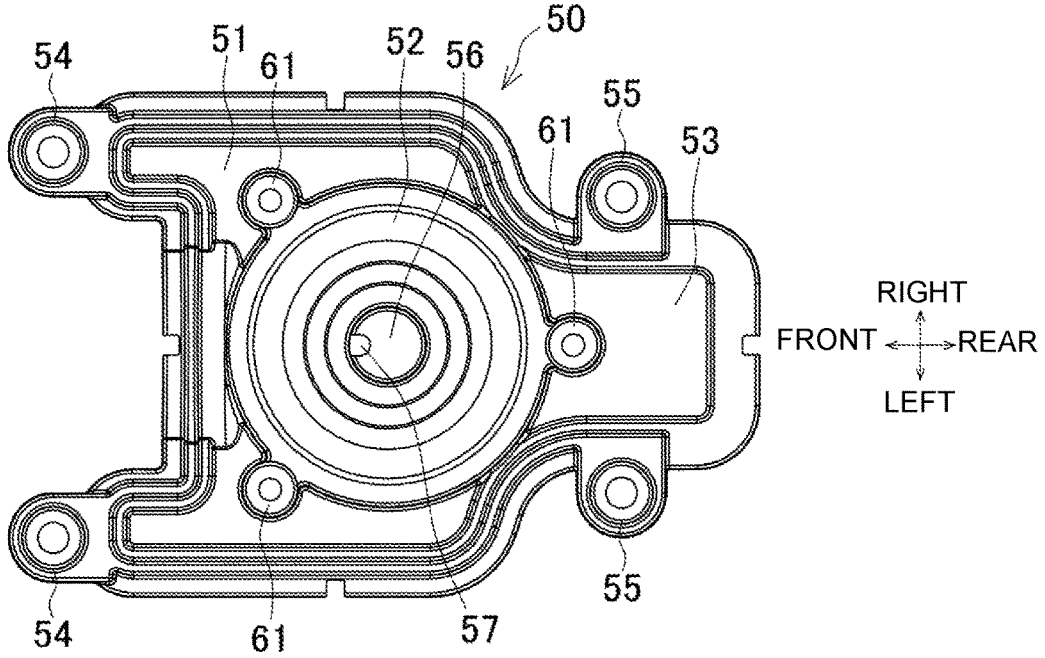
FIG. 5A is a plan view of the cap.
Figure 5B:
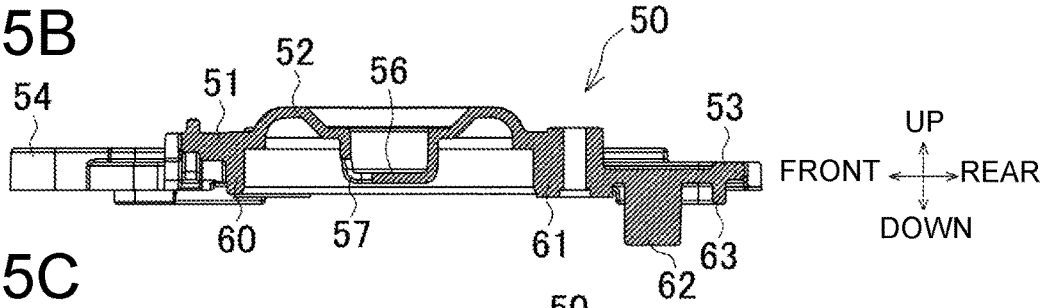
FIG. 5B is a longitudinal central sectional view of the cap.
Figure 5C:
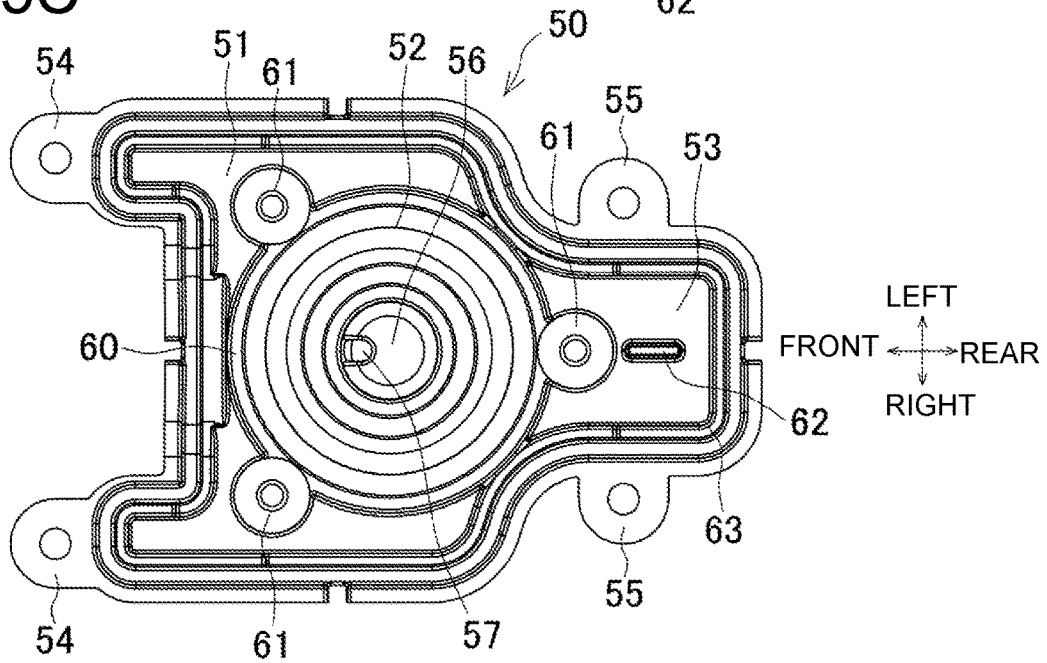
FIG. 5C is a bottom view of the cap.

As shown in FIGS. 2 and 3, the crank housing 22 has a grease supply port 44 for the crank chamber 26 in its upper surface inside the rear housing 24. A cap 50 is attached to the supply port 44. As shown in FIGS. 4 to 5C, the cap 50 includes a front portion 51, which is rectangular as viewed from above, and a rear portion 53. The front portion 51 includes an annular protrusion 52, which protrudes upward. The rear portion 53 is a plate having a smaller lateral width than the front portion 51. The front portion 51 includes, on its front end, a pair of right and left bolt fastening tabs 54 protruding frontward. The rear portion 53 includes, on its two lateral ends, a pair of right and left bolt fastening tabs 55 protruding outward.

The protrusion 52 in the surface of the cap 50 has a central, circular recess 56, which is recessed toward the back of the cap. The circular recess 56 has, in its front portion, a relief hole 57 in its lateral middle for relieving the pressure inside the crank chamber 26. The relief hole 57 is a through-hole extending from the inner surface to the bottom surface of the front portion. As shown in FIGS. 2 and 3, a sealing plug 58, which holds an air-permeable sealant 59 and has a central through-hole in its upper end, is fitted and fixed in the circular recess 56. The relief hole 57 is thus typically covered.

The cap 50 has, on its back surface, an upright circular rib 60 surrounding a recess defined by the protrusion 52. The circular rib 60 is coaxial with the recess, and extends downward. The circular rib 60 has, on its periphery, two front protruding screw fastening bosses 61, and one rear protruding screw fastening boss 61. Behind the rear screw fastening boss 61, a rib 62 extends downward in the front-rear direction.

The cap 50 includes, on its back surface, a peripheral rib 63 continuous along the periphery of the front portion 51 and the rear portion 53 excluding the bolt fastening tabs 54 and 55. The peripheral rib 63 is fitted in the supply port 44.

Figure 6:
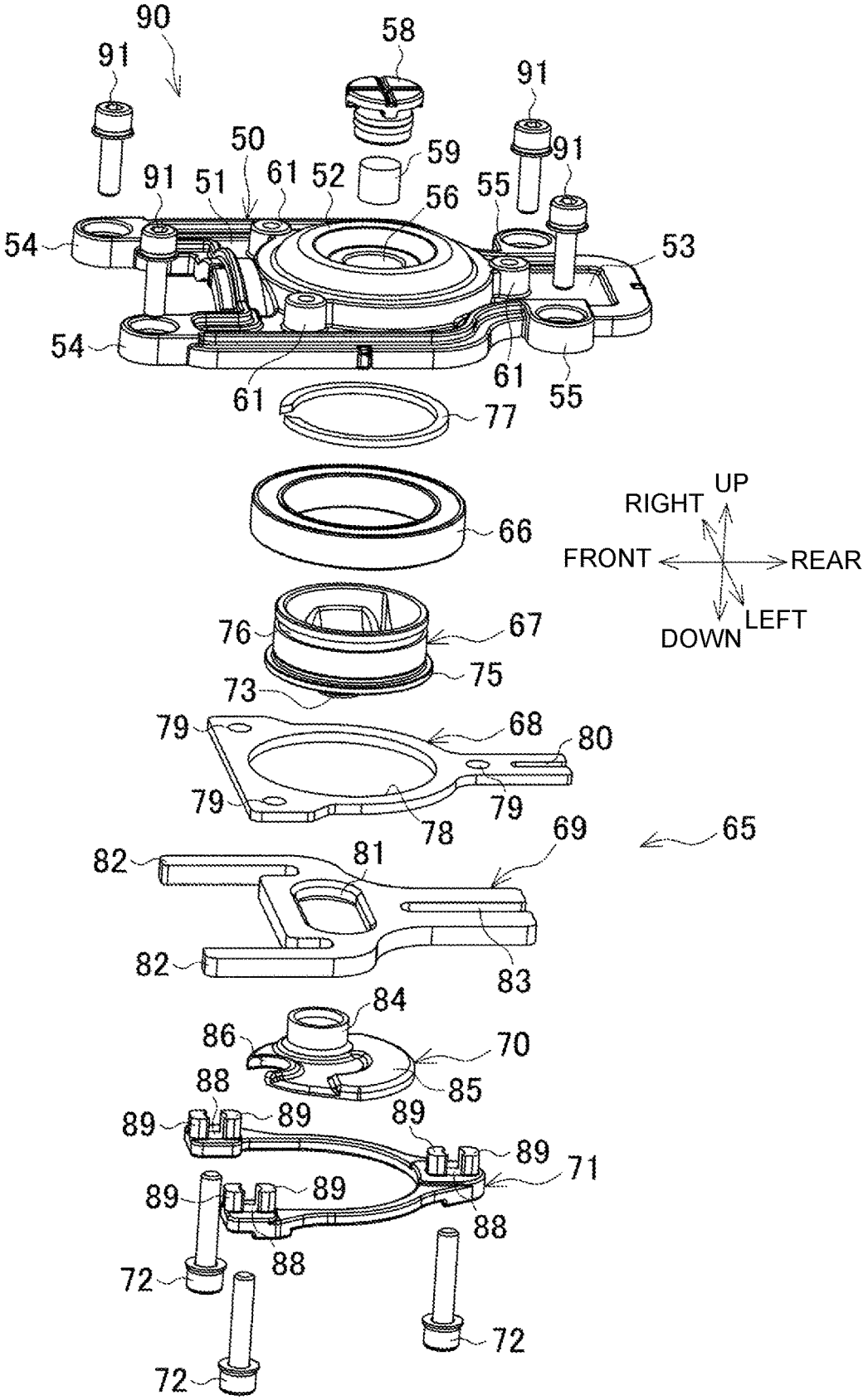
FIG. 6 is an exploded perspective view of the cap unit.
Figure 7A:
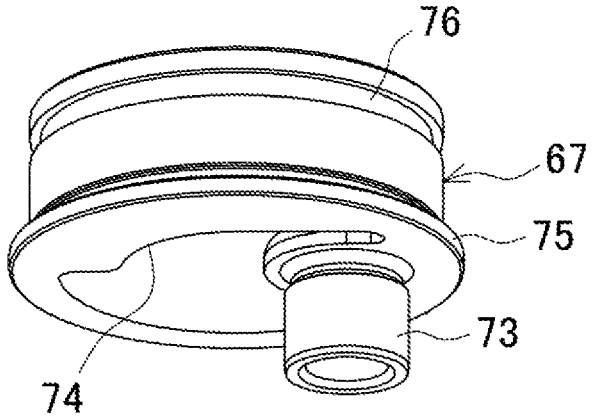
FIG. 7A is a perspective view of an upper crank from below.
Figure 7B:
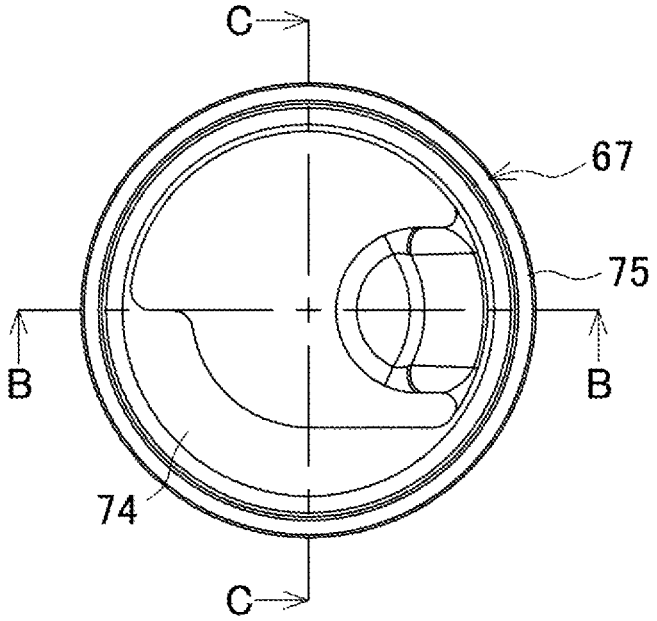
FIG. 7B is a plan view of the upper crank.
Figure 7C:
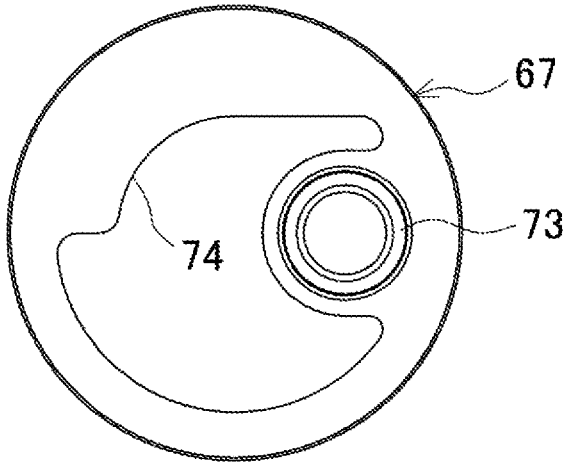
FIG. 7C is a bottom view of the upper crank.
Figure 8A:
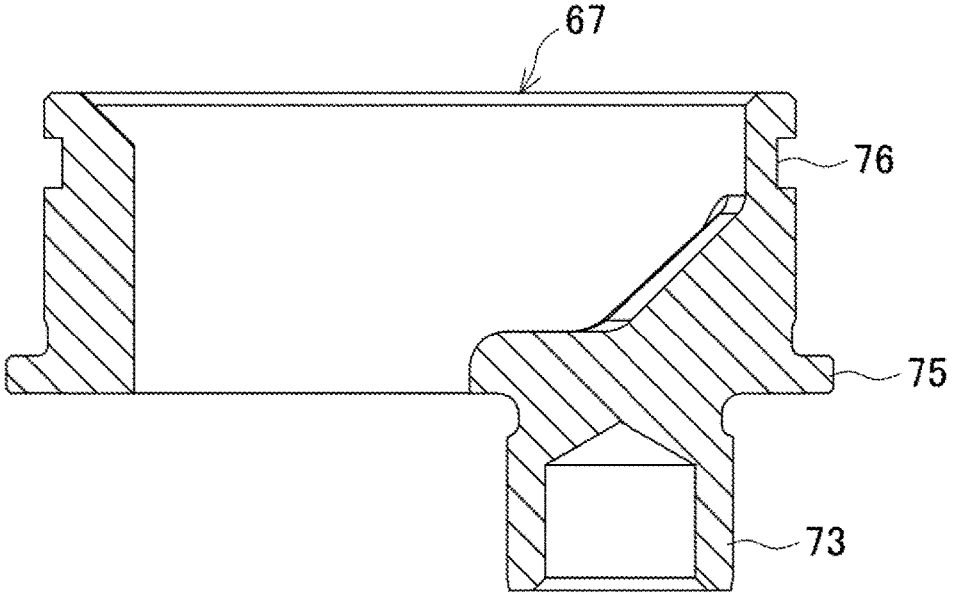
FIG. 8A is a sectional view taken along line B-B in FIG. 7B.
Figure 8B:
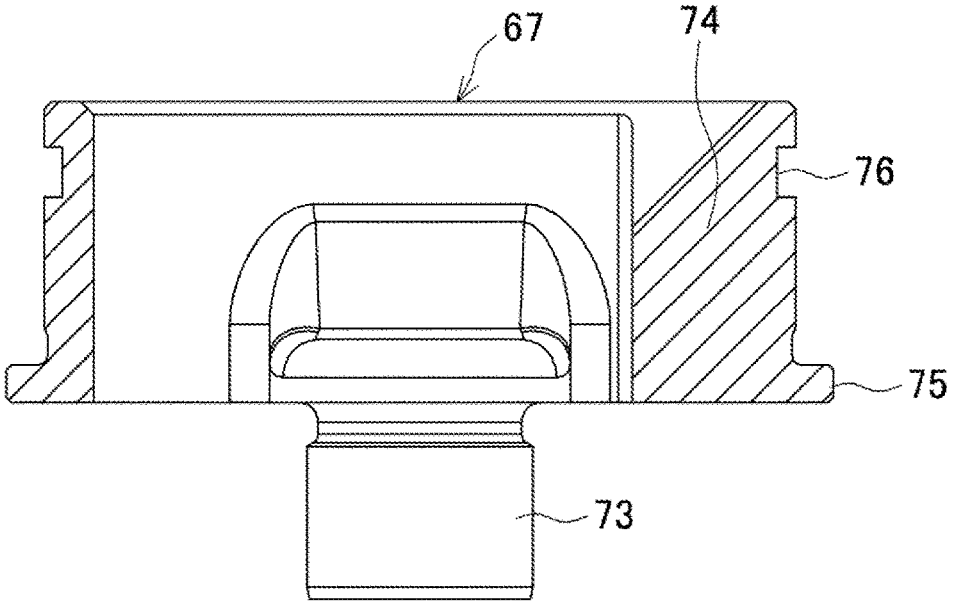
FIG. 8B is a sectional view taken along line C-C in FIG. 7B.

The cap 50 has a low-vibration mechanism 65 mounted integrally on its back surface. As shown in FIG. 6, the low-vibration mechanism 65 includes an upper crank 67, a retainer 68, a counterweight 69, a lower crank 70, and a holder 71. The upper crank 67 is a rotatable member that is supported axially with a ball bearing 66, which is a bearing fitted with the circular rib 60. The retainer 68 fixes the ball bearing 66 onto the back surface of the cap 50. The counterweight 69 (first counterweight) is held below the retainer 68 in a manner movable back and forth. The lower crank 70 is a connecting member located below the counterweight 69, and connects to the upper crank 67 across the counterweight 69. The holder 71 located outside the lower crank 70 is fastened to the cap 50 from below the counterweight 69 with bolts 72, and holds the counterweight 69. The upper crank 67 and the lower crank 70 serve as a second counterweight.

The upper crank 67 is cylindrical, and has its upper end placed inside the protrusion 52 and is axially supported by the ball bearing 66. As shown in FIGS. 7A to 8B, the upper crank 67 includes a cylindrical portion 73 and an upper weight portion 74. The cylindrical portion 73 protrudes downward from an eccentric position on the inner circumference of the upper crank 67. The upper weight portion 74 has a phase different from the phase of the cylindrical portion 73, and has a thickness increasing radially toward the axis. The upper crank 67 has a flange 75 on its lower peripheral end. The flange 75 engages with the bottom of the ball bearing 66. The upper crank 67 has a fitting groove 76 on its upper peripheral end for an engaging ring 77. The engaging ring 77 engages with the upper surface of the ball bearing 66.

The retainer 68 has a through-hole 78 and three small holes 79. The through-hole 78 has a diameter smaller than the outer diameter of the ball bearing 66 and larger than the outer diameter of the upper crank 67. The small holes 79 are located around the through-hole 78, and correspond to the screw fastening bosses 61. The rear part with the small hole 79 extends rearward, and has a slit 80 on its rear end for receiving the rib 62 on the cap 50.

Figure 9A:
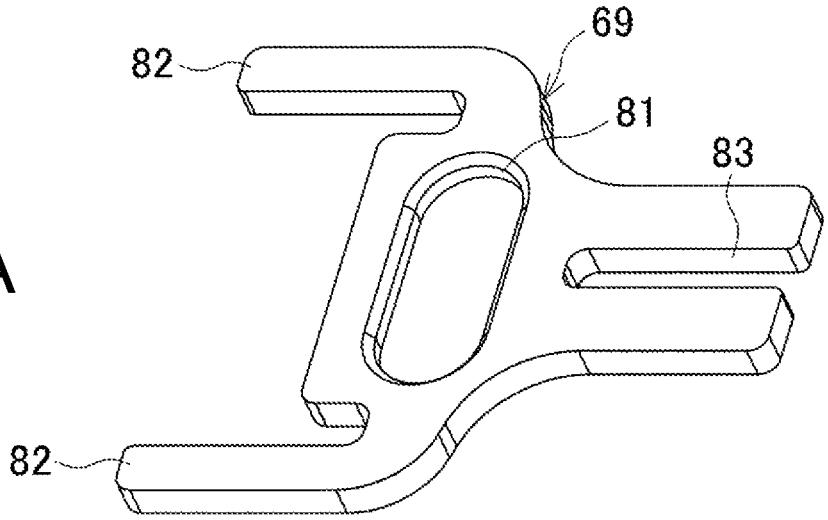
FIG. 9A is a perspective view of a counterweight.
Figure 9B:
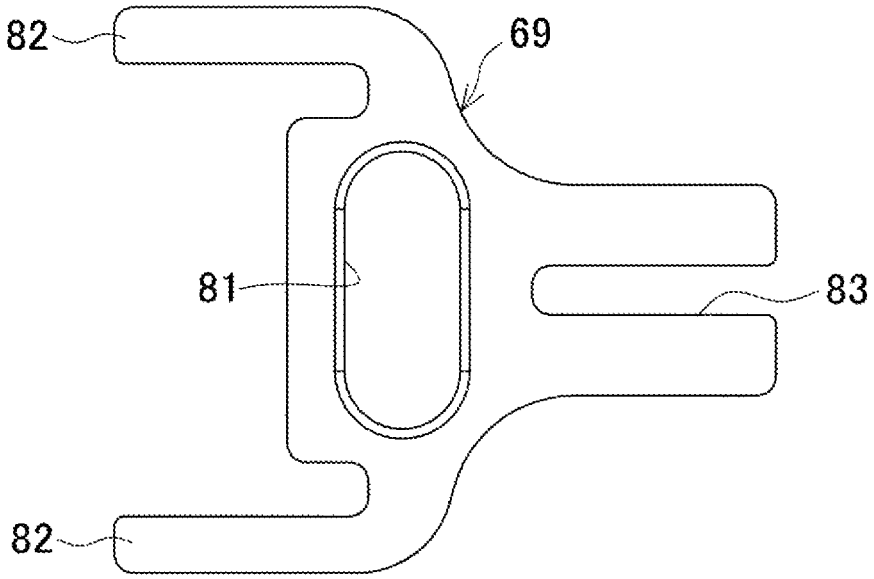
FIG. 9B is a plan view of the counterweight.
Figure 9C:
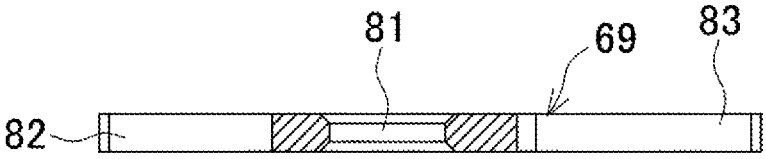
FIG. 9C is a longitudinal central sectional view of the counterweight.
Figure 10A:
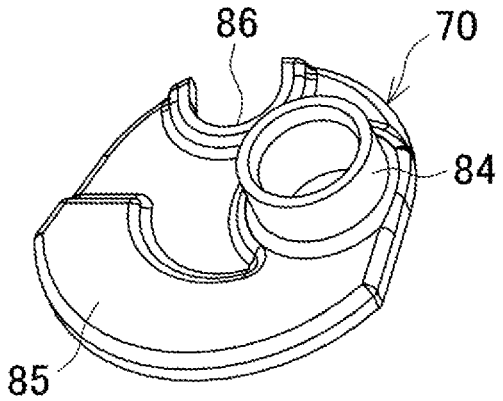
FIG. 10A is a perspective view of a lower crank from above.
Figure 10B:
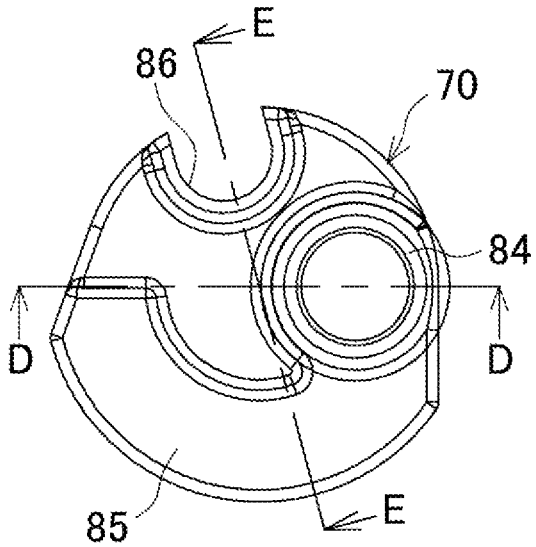
FIG. 10B is a plan view of the lower crank.
Figure 10C:
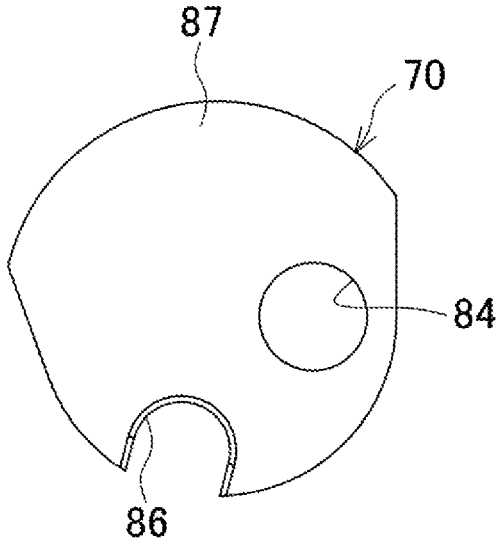
FIG. 10C is a bottom view of the lower crank.
Figure 11A:
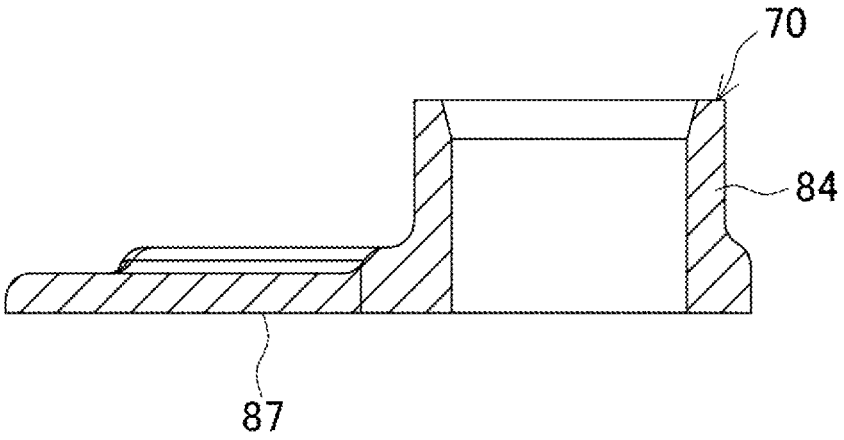
FIG. 11A is a sectional view taken along line D-D in FIG. 10B.
Figure 11B:
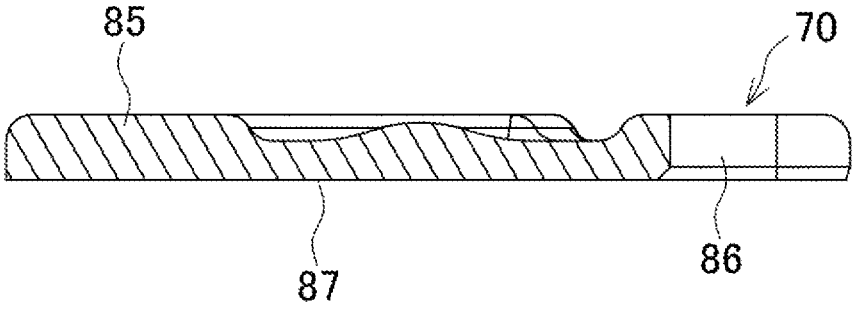
FIG. 11B is a sectional view taken along line E-E in FIG. 10B.
Figure 12A:
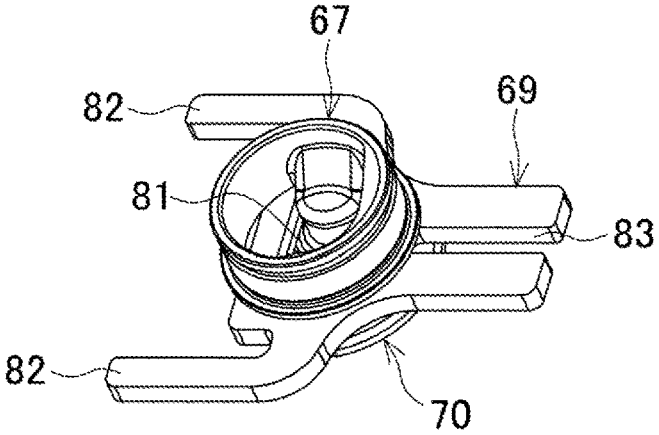
FIG. 12A is a perspective view of the counterweight including the upper crank and the lower crank as viewed from above.
Figure 12B:
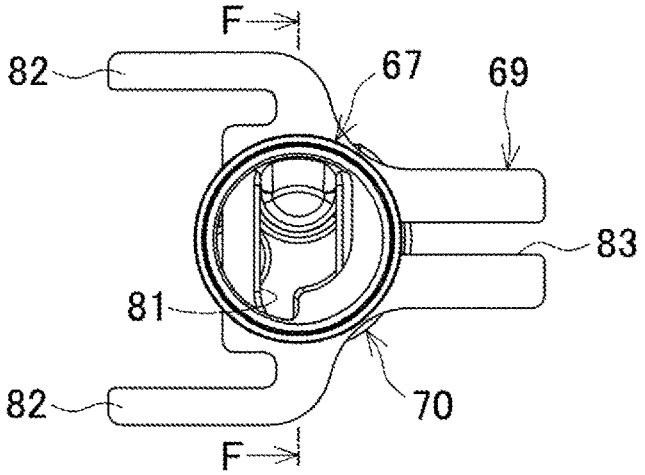
FIG. 12B is a plan view of the counterweight including the upper crank and the lower crank.
Figure 12C:
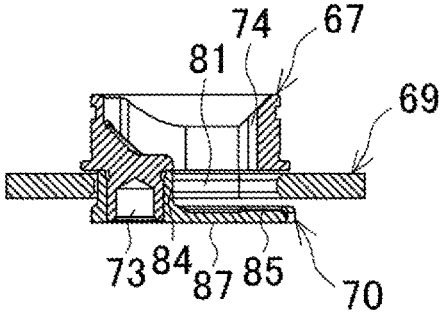
FIG. 12C is a sectional view taken along line F-F in FIG. 12B.
Figure 12D:
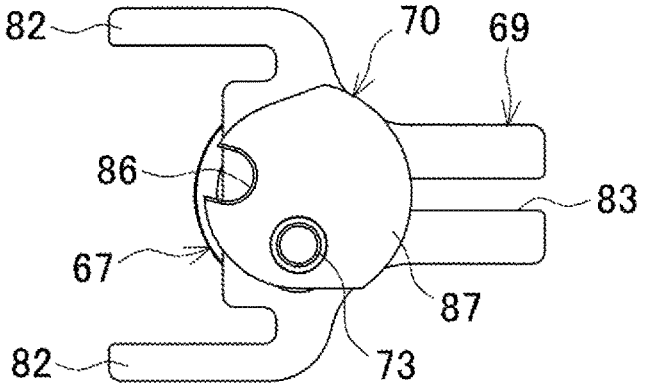
FIG. 12D is a bottom view of the counterweight including the upper crank and the lower crank.

As shown in FIGS. 9A to 9C, the counterweight 69 is a plate with a central slot 81. The counterweight 69 extends in the front-rear direction. The cylindrical portion 73 extends through the slot 81. The slot 81 has a lateral length that allows the cylindrical portion 73 to move eccentrically as the upper crank 67 rotates. The counterweight 69 includes a pair of right and left front arms 82 that are arranged laterally in its front portion. The front arms 82 are spaced by the internal length slightly larger than the length between and including the two small holes 79 frontward in the retainer 68. The counterweight 69 has a laterally central guide slit 83 rearward. The guide slit 83 has a width greater than the diameter of the small hole 79 located rearward in the retainer 68. The guide slit 83 has a length from the rear end across the entire stroke of the counterweight 69 to avoid the small hole 79.

The lower crank 70 is a disk having substantially the same diameter as the upper crank 67. As shown in FIG. 10A to 11B, the lower crank 70 includes, on its upper surface, a receiving cylinder 84 extending upward. The receiving cylinder 84 receives the cylindrical portion 73 that is press-fit through the slot 81. The lower crank 70 includes, on its periphery, a lower weight portion 85 having a phase different from the phase of the receiving cylinder 84. The lower weight portion 85 has a thickness increasing upward. The upper weight portion 74 overlaps the lower weight portion 85 in the vertical direction when the cylindrical portion 73 and the receiving cylinder 84 are joined together. The lower crank 70 includes, on its periphery, a cutout 86 (engageable portion) having a phase different from the phases of the receiving cylinder 84 and the lower weight portion 85 (a phase with a difference of 45 degrees or more in the circumferential direction). The cutout 86, which opens at the periphery, is engageable with the upper end of the eccentric pin 17. The lower crank 70 has an entirely flat bottom 87.

The holder 71 is U-shaped as viewed from above. The holder 71 opens frontward and externally surrounds the lower crank 70. The holder 71 has through-holes 88 for the bolts 72 in its right and left front ends and at the lateral center in its rear end. Guide protrusions 89, which protrude upward, are arranged in front of and behind the through-holes 88. The front guide protrusions 89 fit inside the right and left front arms 82 of the counterweight 69. The rear guide protrusions 89 fit in the guide slit 83.

The low-vibration mechanism 65 is mounted onto the cap 50 in the manner described below.

The upper crank 67 and the lower crank 70 have the counterweight 69 sandwiched between them from above and below. The cylindrical portion 73 is press-fit into the receiving cylinder 84 through the slot 81. The upper weight portion 74 and the lower weight portion 85 are thus connected to have the same phase. As shown in FIGS. 12A to 12D, the upper crank 67 and the lower crank 70 are connected with the counterweight 69 held between them. In this state, the upper weight portion 74 and the lower weight portion 85, which overlap each other in the axial direction of the upper crank 67 and the lower crank 70, are located in a semicircular area with a center having a phase 180 degrees different from the phase of the cutout 86 (point symmetric position).

With the retainer 68 on the upper surface of the counterweight 69, the ball bearing 66 is externally mounted on the upper crank 67 and fastened with the engaging ring 77. The ball bearing 66 is then fitted, from above, with the circular rib 60 of the cap 50, which is inverted without the sealing plug 58 fitted in. The rib 62 is then inserted in the slit 80.

Figure 13:
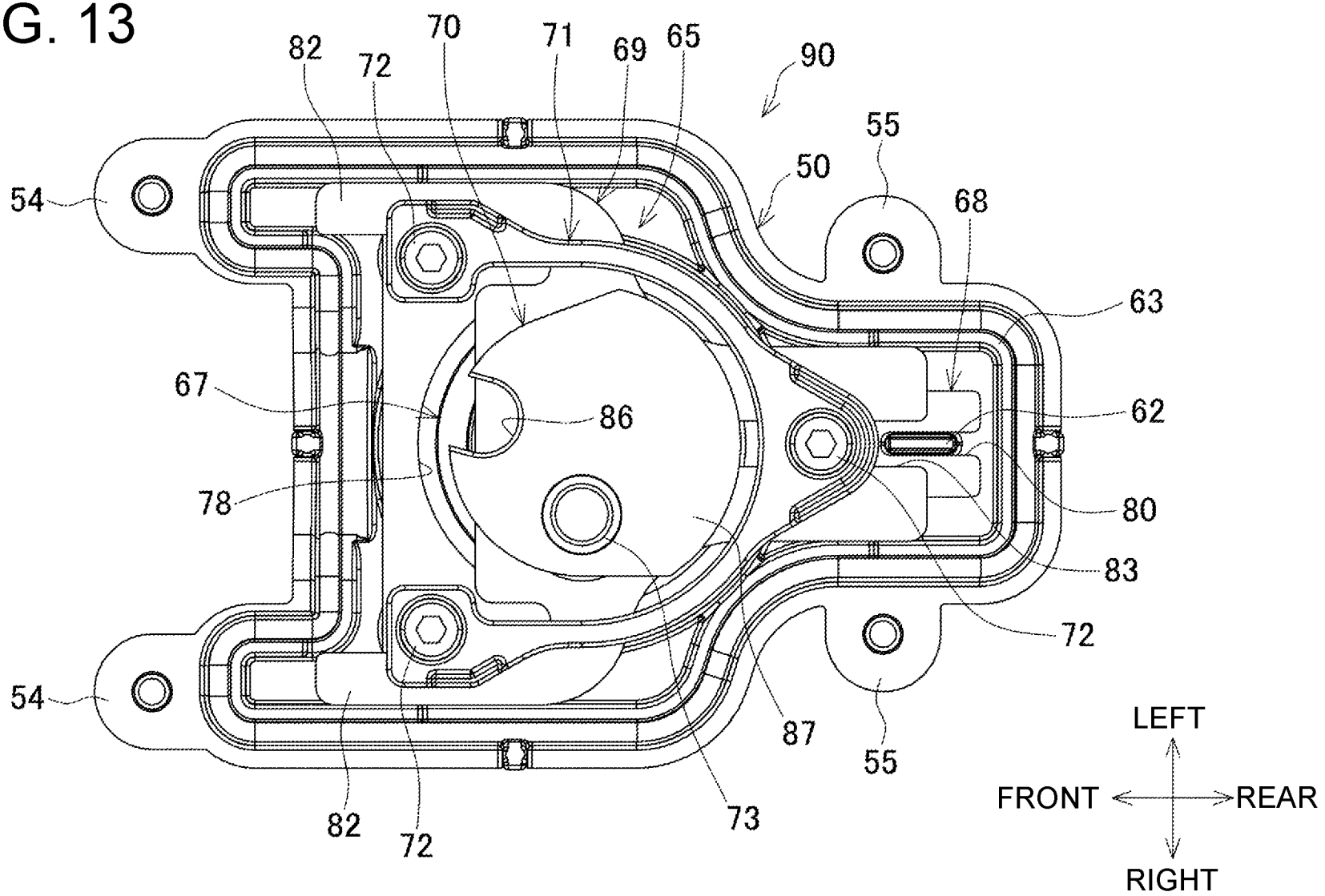
FIG. 13 is a bottom view of the cap unit.

The right and left front guide protrusions 89 of the holder 71 are, from above the counterweight 69, fitted inside the corresponding front arms 82, and the rear guide protrusions 89 are fitted in the guide slit 83. The through-holes 88 and the small holes 79 are aligned with the screw fastening bosses 61. The bolts 72 inserted through the through-holes 88 and the small holes 79 are then screwed into the screw fastening bosses 61. This completes a cap unit 90 shown in FIG. 13 containing the low-vibration mechanism 65 integrally mounted on the back surface of the cap 50.

Figure 14:
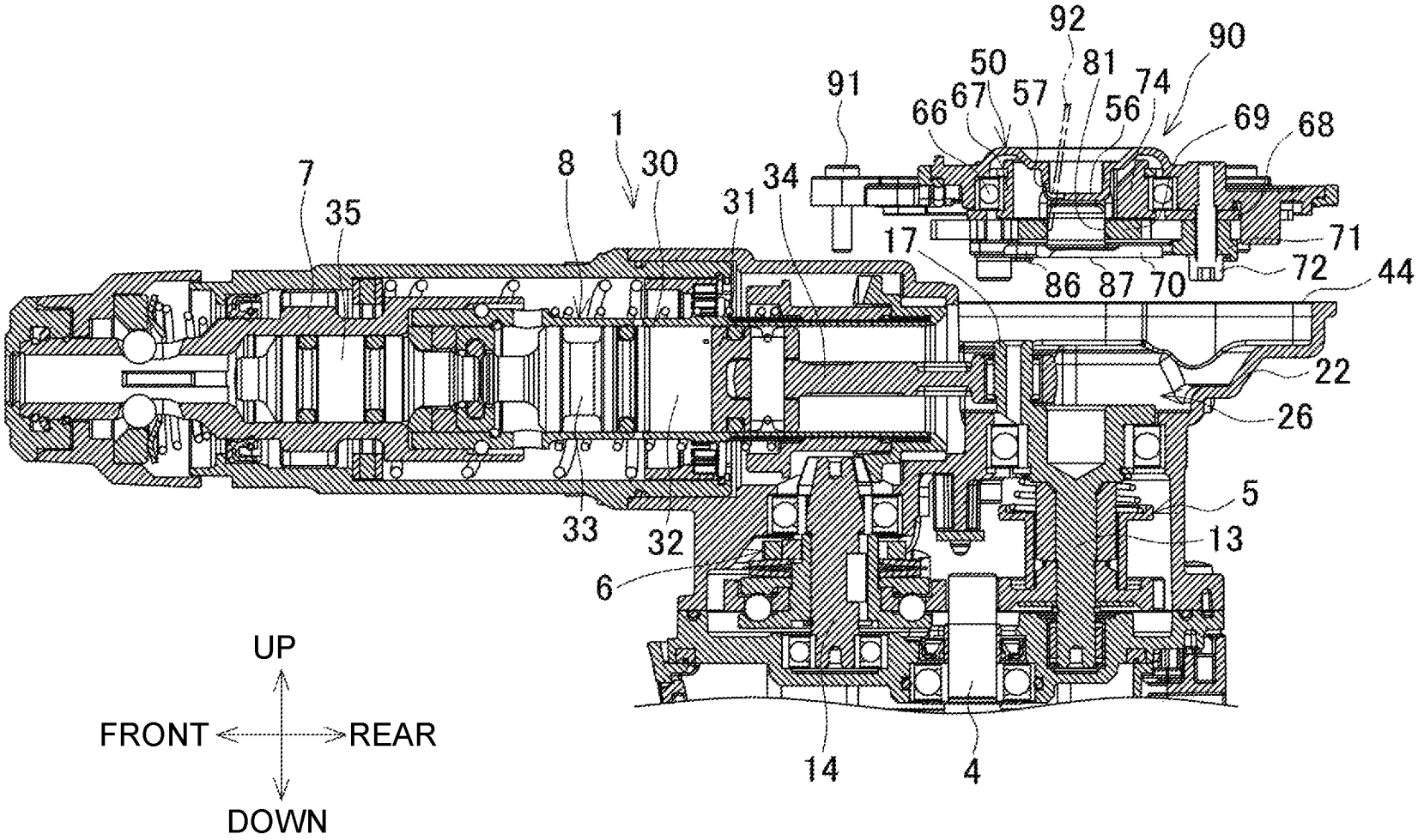
FIG. 14 is a longitudinal central sectional view of the cap unit being mounted.

As shown in FIG. 14, the cap unit 90 is mounted onto the crank housing 22, to which the rear housing 24 has yet to be mounted, from above with four bolts 91 fastened through the front and rear bolt fastening tabs 54 and 55 to close the supply port 44. The rotational positions of the upper crank 67 and the lower crank 70 are aligned preliminarily to allow the upper end of the eccentric pin 17 to engage with the cutout 86.

To prevent the aligned lower crank 70 from rotating unexpectedly, the relief hole 57 in the circular recess 56 is used as an insertion opening for a rod 92, which is a separate member such as a screwdriver. The rod 92 is inserted and engaged with the inner periphery of the slot 81. This locks the rotation of the lower crank 70 with the counterweight 69 and allows the eccentric pin 17 to engage with the cutout 86 smoothly. The bottom 87 of the lower crank 70 is flat, and can guide the eccentric pin 17 to the cutout 86 without causing the eccentric pin 17 to be caught.

In the hammer drill 1 according to the present embodiment having the cap unit 90 mounted, the low-vibration mechanism 65 on the back surface of the cap 50 is accommodated in the crank chamber 26. In this state, the counterweight 69 is arranged behind the cylinder 30 and partially overlaps the cylinder 30 in the striking axis direction.

When the switch lever 11 is pressed to turn on the switch 10, the motor 3 drives the crank shaft 13 to rotate. This causes the eccentric pin 17 to move eccentrically and reciprocate the piston 31 with the connecting rod 34, thus causing the striker 33 to strike the bit.

When the eccentric pin 17 moves eccentrically, the low-vibration mechanism 65 allows the lower crank 70, which is engaged with the eccentric pin 17, and the upper crank 67 to rotate at the same time. This causes the receiving cylinder 84 to move eccentrically. This eccentric motion inside the slot 81 is used only in the front-rear direction. Thus, the counterweight 69 having the stroke corresponding to the front-rear movement of the receiving cylinder 84 moves back and forth in the striking axis direction, as guided by the front guide protrusions 89 of the holder 71 fitted in the front arms 82, and by the rear guide protrusions 89 fitted in the guide slit 83 of the counterweight 69.

The receiving cylinder 84 has a phase slightly advanced in the direction of the eccentric motion than the cutout 86 to be engaged with the eccentric pin 17. When the eccentric pin 17 is at the most advanced position (the front dead center of the piston 31), the counterweight 69 is advanced beyond the rear dead center of its stroke. The counterweight 69 is thus used to reduce vibrations resulting from the striking motion as the piston 31 reciprocates, by canceling the shifted center of gravity. The counterweight 69 operates (at the dead center) at an advanced position corresponding to the position of the eccentric pin 17 advanced from the reference position of the eccentric pin 17 at which the piston 31 reaches the dead center. This causes a time lag between the reciprocation of the piston 31 and the subsequent movement of the striker 33 (or the striker 33 reaches the dead center before the piston 31 through the pneumatic chamber 32), and thus allows the center of gravity to shift before the reciprocation of the piston 31.

The eccentric pin 17 moves eccentrically to rotate the upper crank 67 and the lower crank 70. This causes the upper weight portion 74 and the lower weight portion 85 to move eccentrically with a phase opposite to the phase of the eccentric pin 17. This cancels the rotational imbalance resulting from rotation of the crank shaft 13 or the rear end of the connecting rod 34 using the upper weight portion 74 and the lower weight portion 85.

The hammer drill 1 according to the present embodiment includes, inside the housing 2, the counterweight 69 and the second counterweight (the upper crank 67 and the lower crank 70) at a portion at which the cap 50 closes the supply port 44. The counterweight 69 moves in cooperation with the crank mechanism 5 for reducing vibrations in the striking axis direction as the piston 31 reciprocates. The second counterweight (the upper crank 67 and the lower crank 70) rotates in cooperation with the crank mechanism 5 for reducing vibrations in the rotational direction resulting from the rotatable components including the crank shaft 13. This structure reduces vibrations resulting from the reciprocating piston 31, and vibrations resulting from the rotating components such as the crank shaft 13.

More specifically, the operating position of the counterweight 69 is determined in accordance with the position of the eccentric pin 17 advanced in the direction of the eccentric motion from its reference position, at which the piston 31 reaches the dead center. This allows the counterweight 69 to operate at the timing corresponding to the actual shift of the center of gravity caused by the striker 33, and thus effectively reduces vibrations in the striking axis direction.

The counterweight 69 is movable back and forth, and partially overlaps the cylinder 30 in the striking axial direction. This shortens the distance between the piston 31 and the counterweight 69, and effectively reduces vibrations resulting from the reciprocating piston 31. Also, the low-vibration mechanism 65 is compact and is accommodated in a space behind the cylinder 30.

The upper crank 67, the lower crank 70, and the ball bearing 66 for axially supporting the upper crank 67 are mounted integrally on the cap 50. This structure enables the ball bearing 66, the upper crank 67, and the lower crank 70 to be removed or replaced when the cap 50 is removed. This improves the workability for repair or maintenance of the low-vibration mechanism 65.

The upper crank 67 and the lower crank 70, which rotate in cooperation with the eccentric pin 17, engage with the engageable portion (cutout 86) of the eccentric pin 17 and are mounted integrally on the cap 50. This enables the entire low-vibration mechanism 65 to be removed or replaced when the cap 50 is removed.

The second counterweight includes the upper crank 67 and the lower crank 70. The upper crank 67 is axially supported by the ball bearing 66 and held in a rotatable manner relative to the cap 50. The lower crank 70 is engaged with the eccentric pin 17 for transmitting rotation. The upper crank 67 includes the upper weight portion 74, and the lower crank 70 includes the lower weight portion 85. This structure easily sets the positions and weights of the upper and lower weight portions 74 and 85 for effectively reducing vibrations in the rotational direction.

The counterweight 69 is arranged between the upper crank 67 and the lower crank 70 in a manner movable back and forth in the striking axis direction. This reduces the size of the low-vibration mechanism 65 in the vertical direction.

The cap 50 has an insertion opening (relief hole 57) through which an external separate member is insertable for directly or indirectly locking the rotation of the lower crank 70. This allows the lower crank 70 to engage with the eccentric pin 17 smoothly, thus improving the workability for mounting the cap unit 90. The position of the lower crank 70 may also be adjusted easily using the separate member.

More specifically, the relief hole 57 in the cap 50, which is used for relieving pressure inside the crank chamber 26 accommodating the crank mechanism 5, also serves as the insertion opening. This eliminates additional processing of the cap 50. The existing relief hole 57 can easily be used to lock the rotation of the lower crank 70.

Although the upper crank and the lower crank each include a weight portion in the present embodiment, the weight portion may be included in one of the cranks. The integrated weight may be replaced by a separate weight forming the weight portion.

The cylindrical portion and the receiving cylinder may be reversed to achieve the connection between the upper crank and the lower crank, or a separate connection pin may be used to achieve connection across the upper and lower cranks.

The second counterweight may not be a combination of the upper crank and the lower crank. In some embodiments, the first counterweight may be located to avoid the second counterweight or may be shaped not to interfere with the second counterweight. Thus, the first counterweight may not reciprocate in the striking axis direction, but may rotate.

Although the low-vibration mechanism above the lower crank, which includes the engageable portion for the eccentric pin, is mounted on the cap in the present embodiment, the second counterweight and the bearing may be mounted on the cap and the other components may be mounted inside a housing depending on the forms of the first and the second counterweights. The low-vibration mechanism may be separate from the cap and may be incorporated in a housing.

The striking tool may not be a hammer drill, and may be a tool for which a drill mode is selectable, a tool with a brushless motor, a tool using a battery pack as a power source, an electric hammer, or a striking tool including a striking mechanism, a crank mechanism, a grease supply port, and a cap.

REFERENCE SIGNS LIST

1 hammer drill
2 housing
3 motor
4 output shaft
5 crank mechanism
6 rotation transmission mechanism
7 tool holder
8 striking mechanism
13 crank shaft
14 intermediate shaft
17 eccentric pin
22 crank housing
26 crank chamber
30 cylinder
31 piston
33 striker
34 connecting rod
44 supply port
50 cap
56 circular recess
57 relief hole
58 sealing plug
65 low-vibration mechanism
66 ball bearing
67 upper crank
68 retainer
69 counterweight
70 lower crank
71 holder
72, 91 bolt
73 cylindrical portion
74 upper weight portion
81 slot
84 receiving cylinder
85 lower weight portion
86 cutout
90 cap unit
92 rod

What is claimed is:

1. A striking tool, comprising:
a housing including a supply port;
a striking mechanism in the housing, the striking mechanism including
a striker movable back and forth in a striking axis direction, and
a piston configured to move the striker back and forth;
a crank mechanism in the housing, the crank mechanism including
a crank shaft rotatable when driven by a motor, and
an eccentric pin on the crank shaft, the eccentric pin being movable eccentrically;
a cap attached to the supply port in a removable manner;
a first counterweight in the housing at a position at which the cap closes the supply port, the first counterweight having an elongated hole (1) extending perpendicular to the striking axis direction and (2) that receives a member that causes movement of the first counterweight relative to the housing, the first counterweight being movable in cooperation with the crank mechanism, and being configured to reduce vibrations in the striking axis direction resulting from the piston that is reciprocating; and
a second counterweight in the housing at a position at which the cap closes the supply port, the second counterweight being rotatable in cooperation with the crank mechanism, and being configured to reduce vibrations in a rotational direction resulting from the crank shaft;
wherein the first counterweight is slidable in the striking axis direction but is not rotatable relative to the housing.

2. The striking tool according to claim 1, wherein
the crank mechanism converts rotation of the crank shaft into reciprocation of the piston.

3. The striking tool according to claim 2, further comprising:
a connecting rod connecting the eccentric pin and the piston.

4. The striking tool according to claim 2, wherein
the first counterweight operates at a position corresponding to a position of the eccentric pin advanced in a direction of an eccentric motion from a reference position of the eccentric pin at which the piston reaches a dead center.

5. The striking tool according to claim 2, wherein
the striking mechanism includes a cylinder accommodating the piston, and
the first counterweight is movable back and forth in the striking axis direction and at least partially overlaps the cylinder in the striking axis direction.

6. The striking tool according to claim 2, further comprising:
a bearing axially supporting the second counterweight,
wherein the second counterweight and the bearing are mounted on the cap.

7. The striking tool according to claim 1, further comprising:
a connecting rod connecting the eccentric pin and the piston.

8. The striking tool according to claim 7, wherein
the first counterweight operates at a position corresponding to a position of the eccentric pin advanced in a direction of an eccentric motion from a reference position of the eccentric pin at which the piston reaches a dead center.

9. The striking tool according to claim 7, wherein
the striking mechanism includes a cylinder accommodating the piston, and
the first counterweight is movable back and forth in the striking axis direction and at least partially overlaps the cylinder in the striking axis direction.

10. The striking tool according to claim 7, further comprising:
a bearing axially supporting the second counterweight,
wherein the second counterweight and the bearing are mounted on the cap.

11. The striking tool according to claim 1, wherein
the first counterweight operates at a position corresponding to a position of the eccentric pin advanced in a direction of an eccentric motion from a reference position of the eccentric pin at which the piston reaches a dead center.

12. The striking tool according to claim 11, wherein the striking mechanism includes a cylinder accommodating the piston, and the first counterweight is movable back and forth in the striking axis direction and at least partially overlaps the cylinder in the striking axis direction.

13. The striking tool according to claim 11, further comprising:

a bearing axially supporting the second counterweight, wherein the second counterweight and the bearing are mounted on the cap.

14. The striking tool according to claim 1, wherein the striking mechanism includes a cylinder accommodating the piston, and the first counterweight is movable back and forth in the striking axis direction and at least partially overlaps the cylinder in the striking axis direction.

15. The striking tool according to claim 1, further comprising:

a bearing axially supporting the second counterweight, wherein the second counterweight and the bearing are mounted on the cap.

16. A striking tool, comprising:

a housing including a supply port;

a striking mechanism in the housing, the striking mechanism including a striker movable back and forth in a striking axis direction, and a piston configured to move the striker back and forth;

a crank mechanism in the housing, the crank mechanism including a crank shaft rotatable when driven by a motor, and an eccentric pin on the crank shaft, the eccentric pin being movable eccentrically;

a cap attached to the supply port in a removable manner;

a first counterweight in the housing at a position at which the cap closes the supply port, the first counterweight being movable in cooperation with the crank mechanism, and being configured to reduce vibrations in the striking axis direction resulting from the piston that is reciprocating;

a second counterweight in the housing at a position at which the cap closes the supply port, the second counterweight being rotatable in cooperation with the crank mechanism, and being configured to reduce vibrations in a rotational direction resulting from the crank shaft; and a bearing axially supporting the second counterweight, wherein:

the second counterweight and the bearing are mounted on the cap; and the second counterweight includes an engageable portion engageable with the eccentric pin, rotates in cooperation with the eccentric pin, and is mounted on the cap.

17. A striking tool, comprising:

a housing including a supply port;

a striking mechanism in the housing, the striking mechanism including a striker movable back and forth in a striking axis direction, and a piston configured to move the striker back and forth;

a crank mechanism in the housing, the crank mechanism including a crank shaft rotatable when driven by a motor, and an eccentric pin on the crank shaft, the eccentric pin being movable eccentrically;

a cap attached to the supply port in a removable manner;

a first counterweight in the housing at a position at which the cap closes the supply port, the first counterweight being movable in cooperation with the crank mechanism, and being configured to reduce vibrations in the striking axis direction resulting from the piston that is reciprocating;

a second counterweight in the housing at a position at which the cap closes the supply port, the second counterweight being rotatable in cooperation with the crank mechanism, and being configured to reduce vibrations in a rotational direction resulting from the crank shaft, and a bearing axially supporting the second counterweight, wherein:

the second counterweight and the bearing are mounted on the cap;

the second counterweight includes:

a rotatable member axially supported by the bearing and held in the cap in a rotatable manner; and a connecting member engageable with the eccentric pin to receive rotation; and at least one of the rotatable member or the connecting member includes a weight portion.

18. The striking tool according to claim 17, wherein the first counterweight is located between the rotatable member and the connecting member in a manner movable back and forth in the striking axis direction.

19. The striking tool according to claim 17, wherein the cap has an insertion opening through which an external separate member is insertable to directly or indirectly lock rotation of the connecting member.

20. The striking tool according to claim 19, wherein the insertion opening relieves pressure inside a crank chamber accommodating the crank mechanism.

* * * * *